US005214892A

United States Patent [19]

Livingston et al.

[11] Patent Number: 5,214,892

[45] Date of Patent: Jun. 1, 1993

[54] MOLDING STRIP FOR MOUNTING A FLEXIBLE COVERING ONTO A SUPPORT SURFACE

[76] Inventors: Bryan K. Livingston, 12170 Cardamom Dr., Woodbridge, Va. 22192; Douglas M. Hopkins, 7412 Floyd Ave., Springfield, Va. 22150

[21] Appl. No.: 830,324

[22] Filed: Jan. 31, 1992

Related U.S. Application Data

[63] Continuation-in-part of Ser. No. 660,232, Feb. 25, 1991.

[51] Int. Cl.[5] ..... E04B 1/00

[52] U.S. Cl. ..... 52/222; 52/273; 24/562

[58] Field of Search ..... 52/222, 63, 202, 203, 52/273; 24/457, 545, 555, 556, 562

[56] References Cited

U.S. PATENT DOCUMENTS

| | | | |
|---|---|---|---|
| 3,303,626 | 2/1967 | Brigham | 52/475 |
| 3,513,613 | 5/1970 | Jones et al. | 52/222 |
| 3,857,216 | 12/1974 | Sherman | 52/489 |
| 4,018,260 | 4/1977 | Baslow . | |
| 4,053,008 | 10/1977 | Baslow . | |
| 4,151,762 | 5/1979 | Baslow . | |
| 4,161,977 | 7/1979 | Baslow . | |
| 4,189,880 | 2/1980 | Ballin | 52/202 |
| 4,197,686 | 4/1980 | Baslow . | |
| 4,333,284 | 6/1982 | Meadows | 52/222 |
| 4,441,290 | 4/1984 | Abell | 52/202 |
| 4,590,727 | 5/1986 | Ghahremani et al. | 52/222 |
| 4,625,490 | 12/1986 | Baslow . | |
| 4,631,882 | 12/1986 | Sease . | |
| 4,731,960 | 3/1988 | Sease . | |
| 4,788,806 | 12/1988 | Sease . | |

FOREIGN PATENT DOCUMENTS

| | | | |
|---|---|---|---|
| 2021074 | 11/1970 | Fed. Rep. of Germany . | |
| 389873 | 7/1965 | Switzerland | 52/222 |
| 2051914 | 1/1981 | United Kingdom . | |

OTHER PUBLICATIONS

"Novawall Architectural Fabric Wall/Ceiling Systems" (Brochure).

*Primary Examiner*—Michael Safavi

*Attorney, Agent, or Firm*—Wenderoth, Lind & Ponack

[57] ABSTRACT

A molding strip for use in a molding strip assembly supports flexible materials on a surface with insulation provided between the flexible materials and the surface. The molding strip has an elongated base having a backside, a front side and first and second side edges that extend in the direction of elongation of the base. A first gripper wall extends perpendicularly from the front side of the base. A second gripper wall includes a first wall portion that extends from the base at a position on the base spaced from the first gripper wall, a second wall portion extending from the first wall portion toward the first gripper wall so that a space is defined by the base, the first gripper wall, the first wall portion of the second gripper wall and the second wall portion of the second gripper wall, and a third wall portion that extends from the second wall portion parallel to the first gripper wall. The first gripper wall and the third wall portion have mutually confronting portions with gripper arrangements thereon for gripping a fabric material. A flange extends from the third wall portion of the second gripper wall in a direction away from the first gripper wall, over the second wall portion and spaced from the second wall portion, for covering a space formed above the second wall portion between the third wall portion and insulation placed adjacent the first wall portion.

14 Claims, 3 Drawing Sheets

MOLDING STRIP FOR MOUNTING A FLEXIBLE COVERING ONTO A SUPPORT SURFACE

This application is a Continuation-In-Part of U.S. patent application Ser. No. 07/660,232, filed Feb. 25, 1991.

BACKGROUND OF THE INVENTION

The present invention relates generally to extruded molding pieces attachable to a wall to form a frame assembly thereon for the purpose of supporting a fabric covering sheet.

A number of systems and apparatus for supporting a fabric sheet on a surface, such as a wall, are known. Generally, known systems provide a number of extruded pieces which together form a frame mounted on a wall. The fabric sheet to be mounted on the frame then has its edges securely supported by the frame assembly formed by the extruded pieces.

U.S. Pat. Nos. 4,631,882 and 4,788,806 to Sease disclose such systems wherein two separate pieces are used together to secure the fabric in place. U.S. Pat. No. 4,731,960, also to Sease, discloses another such extrusion wherein the edges of the fabric are simply held between gripping teeth formed on portions of an extruded piece. Small spaces are provided for storing the leftover edge of the fabric being supported.

U.S. Pat. Nos. 4,018,260, 4,053,008, 4,151,672 and 4,161,977, all to Baslow, are related to frame assemblies for mounting fabric sheets. Baslow uses extruded members which provide a storage space in the extruded member for fabric, along with gripping teeth, but require the use of a spline to sufficiently support the fabric being stretched on a particular frame assembly. The patent to Baslow U.S. Pat. No. 4,161,977 simply uses gripper teeth and a small storage space in a solid member for supporting a fabric sheet. There also exist U.S. Pat. Nos. 4,197,686 and 4,625,490, both also to Baslow, which disclose the use of extruded pieces forming a storage space between walls of the extruded pieces. The fabric is tucked into the storage space formed by the extruded piece by the use of an appropriate stuffing tool.

FIG. 1 discloses a further known extrusion. The extrusion of FIG. 1 is used in frame assemblies for fabric wall coverings for the purpose of providing a mid-wall support inside a frame assembly. This extrusion, noting FIG. 1, comprises a base wall 1 having upstanding walls 2 and 3 extending therefrom. The walls 2 and 3 form a cavity or space therebetween for the insertion of fabric material. The walls neck together to form an inlet at 4, whereat is provided a number of gripping teeth for gripping a fabric inserted therein. Two wall portions 5 flare outwardly from the inlet 4.

The extrusion illustrated in FIG. 1 suffers generally from the drawbacks of insufficient size and strength, and an insufficiently sized cavity C for the amount of fabric which may be required to be stuffed into the cavity C. This renders the extrusion with little versatility and adaptability. In many of today's applications, patterns of a fabric to be secured to a wall have repeating vertical patterns, which repeat every so often in the horizontal direction. At the mid-wall seam portion, it is desirable to match the particular position of the pattern of one fabric with the particular position of the pattern of the other fabric adjacent thereto. To do this, one or the other fabric may require significant lateral adjustment. Thus, a substantially large cavity C may be required.

In response to the above problems of the prior art, the inventors of the present application in parent U.S. patent application Ser. No. 07/660,232 proposed a molding strip 20 for use in attaching fabrics to a wall W. FIG. 4 illustrates how a fabric F is placed on the wall W. A number of the molding strips 20 are attached to the wall W so as to form a frame defining the area desired to be covered by the fabric material F. As seen in the figure, four outside molding strips 20 may form a rectangular configuration, with a fifth molding strip 20 forming a midwall-seam portion. The fabric F is then stretched across the area defined by the frame assembly, and the edges thereof are held by the respective molding strips 20. One continuous fabric sheet F may be used, with a central portion thereof tucked into the mid-wall seam portion 20, or two separate fabric portions F could be used.

An insulating material is preferably placed between the fabric F and the wall W within the area of the frame assembly. Such material will provide a backing for the fabric sheet F, as well as providing an insulating material for the purpose of absorbing sound in a room. Further, note that the molding strips 20 may be attached to the wall W preferably by simply stapling the molding strips 20 to the wall, or by the use of any other suitable method.

FIGS. 2 and 3 show a cross-sectonal view and a perspective view, respectively, of the molding strip 20 according to U.S. Ser. No. 07/660,232. The molding strip 20 has a base or base portion 21. The base portion 21 is substantially flat and elongated, as seen in FIG. 3. A back side of the base portion 21 is placed against the wall or other surface to which the molding strip 20 is to be attached. The front side of the base portion 21 has two walls 22 and 23 extending outwardly therefrom.

Preferably, the walls 22 and 23 extend substantially perpendicularly to the base portion 21, but the angle of the walls 22 and 23 relative to the base portion 21 may vary somewhat from the perpendicular without substantially affecting the nature and operation of the present invention. At their upper ends, as seen in FIG. 4, each wall 22 and 23 has a respective mutually confronting portion 24 and 25. Connecting the confronting portion 24 of the wall member 22 to a main wall portion 26 of wall member 22 is a shoulder portion 27. The main portion 26 and wall member 23 are spaced from each other so as to form a space or cavity c therebetween. The shoulder 27 serves to close off the cavity C, and the respective confronting portions 24 and 25 serve to define an inlet into the cavity C.

As can be seen in FIG. 3, wall members 22 and 23 extend parallel to first and second side edges of the base portion 21 in the longitudinal direction of the base portion 21, covering its entire extent. In addition, a gripping arrangement is provided between the confronting portions 24 and 25 for the purpose of gripping a fabric sheet or material inserted into the inlet defined between the confronting portions. Preferably the gripping arrangement is a plurality of gripper teeth provided on both of the confronting portions. Furthermore, the height of the wall members 22 and 23 in the direction perpendicular to the base portion 21 is preferably the same.

Thus, when a fabric sheet or material F is secured to a molding strip, the fabric sheet or material is tucked into the inlet between confronting portions 24 and 25.

This operation is usually carried out by overlaying the fabric on the inlet and using a thin elongated tool to push the fabric between the confronting portions 24 and 25 into the cavity C. The fabric material is then stored inside the cavity C. When a fabric material F has a particular pattern thereon, and several panels of the type illustrated in FIG. 4 are placed adjacent each other, it will be necessary to horizontally adjust a particular fabric material so that the patterns on adjacent sheets will match. For this purpose, the molding strips 20 making up the frame of a particular fabric sheet or material F must have a cavity C of a sufficiently large size so that the fabric sheet can be horizontally adjusted. That is, the cavity must be large enough so that a fabric sheet F can be relatively freely adjusted in the horizontal direction without worrying about the cavity C not having space enough for all the material that may be required to be stuffed therein.

In a preferred feature of the extrusion 20, with reference to FIG. 2, the distance from a line passing between the confronting portions 24 and 25, whereat is provided the gripper arrangement, extending substantially perpendicularly to the base portion 21, to the first side edge of the base portion 21 is equal to the height of the wall member 22 in a direction substantially perpendicular to the base portion 21. In FIG. 2, these distances are represented by A and B, wherein A=B. As noted above, the height of wall members 22 and 23 is preferably the same. Thus the distance B will also be the height of wall member 23, preferably. This relationship renders the molding strip 20 particularly advantageous to an installer of fabric material wall assemblies. Noting FIG. 5, there is illustrated one molding strip 20 which is used to form an inside corner junction. Two adjacent walls W each are to be provided with a frame assembly for securing a fabric thereto. By providing molding strip 20 at least on the one side thereof toward the first edge of the base portion 21 with a dimension equal to the height of the molding strip 20, the molding strip 20 can be put in position at the corner intersection of the walls W without requiring the installer to measure the correct distance away from the adjacent wall for the positioning of the molding strip 20. That is, the molding strip 20 is merely placed against a wall W with its first side edge substantially abutting the adjacent wall W, and the molding strip 20 is properly positioned with regard to the fabric height on both the walls W, whether a one-half inch or a one inch fabric panel is desired, as seen in FIG. 5.

Referring now to FIG. 6, there is illustrated a molding strip 20 wherein one side portion of the base portion 21 has been cut off at position 28. This is done to provide single extrusion that can be worked in the field to create edge details. In FIG. 6, for example, a prewrap portion F, of a fabric sheet or material is pre-wrapped around the side of the molding strip 20 at which the edge of the molding strip 20 has been cut off in order to provide a particular fabric panel edge detail at an outside wall corner. The strip of pre-wrapped fabric material F, is adhesively applied to the molding strip before attaching the molding strip 20 in place.

SUMMARY OF THE INVENTION

When an insulating material is placed between the fabric F and the wall W within the area of a frame assembly using molding strips 20 having the shoulder 27 as discussed above, the following problem may arise. The insulating material is typically placed flat against the surface to which the molding strips 20 are mounted, with one side thereof abutting or lying adjacent to the main portion 26 of the wall member 22. Ordinarily the insulating material is not sized or cut to size to fit the shoulder 27 of the molding strip 20, and thus a space is formed between the edge of the insulating material and the confronting portion 24 above the shoulder 27 of the molding strip 20. If a person should lean against the fabric material near the molding strips 20, the space between the insulating material and the confronting portion 26 can cause an inconsistent feel due to the lack of insulating material at the space. The resilience of the fabric in response to pressure there against is thus different adjacent to the confronting portion 26. If a person should lean against the fabric material at or near the space, a problem could also be caused in terms of dislocating the fabric material by a tendency of the fabric material to be pulled out of the cavity C due to a sharper downward force on the fabric F immediately adjacent the point where the fabric F enters the cavity C.

The object of the present invention is to solve the above-discussed problem with regard to the molding strips 20 and the space formed above the shoulder 27 when an insulating material leaves a space above the shoulder of the molding strip 20.

The above-recognized problems with regard to molding strips having a shoulder are solved and the above-discussed objects are accomplished by the provision of a molding strip for use in a molding strip assembly for supporting flexible materials on a surface with insulation provided between the flexible materials and the surface, wherein the molding strip has an elongated base having a back side, a front side and first and second side edges extending in the direction of elongation of the base. The molding strip further has a first gripper wall extending substantially perpendicularly from the front side of the base, with a second gripper wall comprising a first wall portion extending from the base at a position on the base spaced from the first gripper wall. A second wall portion extends from the first wall portion toward the first gripper wall so that a space is defined by the base, the first gripper wall, the first wall portion of the second gripper wall and the second wall portion of the second gripper wall. A third wall portion extends from the second wall portion parallel to the first gripper wall, the first gripper wall and the third wall portion having mutually confronting portions with at least one of the mutually confronting portions having a gripping arrangement thereon. The first and second wall portions define a shoulder on the second gripper wall. A flange extends from the third wall portion for covering a space formed above the shoulder between the third wall portion and insulation placed adjacent the shoulder when the molding strip is used together with insulation.

The flange extends from the third wall portion such that, when the flexible material is supported by the molding strip, the flange has no effect on the surface appearance of the flexible material.

The above-discussed object of the present invention is further accomplished by the provision of a flange on a molding strip which extends from the third wall portion of the second gripper wall in a direction away from the first gripper wall, over the second wall portion and spaced from the second wall portion.

Preferably, the flange extends parallel to the base. Further, the flange preferably has a flat upper surface. In addition, the flange extends from a point on the third wall portion substantially above the second wall portion and substantially at, but spaced from, the upper end of the third wall. In other words, the flat upper surface of the flange extends at a location that is below the upper ends of the first and second griper walls.

Further, the flange extends to a plane perpendicular to the base and intersecting the position on the base from which the first wall portion extends.

Preferably, the second wall portion is parallel to the base, defining the shoulder. The upper surface of the flange is also preferably parallel to the shoulder, with the first and third wall portions parallel to the first gripper wall.

Gripping arrangements are ideally provided on both of the mutually confronting portions, the gripping arrangements preferably comprising gripper teeth.

The front side of the base, further, has at least one portion outside of the space for receiving fabric.

In a further preferred feature, the distance in a direction perpendicular to the base from the back side of the base to the upper end of the first gripper wall is equal to the distance in a direction substantially parallel to the base from the first side edge to a line extending substantially centrally between said mutually confronting portions of the first and second gripper walls and perpendicular to the base.

In a further preferred feature, the distance in a direction perpendicular to the base from the back side of the base to the upper end of the first gripper wall is one inch. Alternatively, this distance can be one-half inch.

In further preferred features of the present invention, the base, the first and second gripper walls and the flange are unitary in a one-piece arrangement. The one-piece arrangement is preferably an extrusion of a plastic material.

BRIEF DESCRIPTION OF THE DRAWINGS

Further objects, features and advantages of the present invention will be apparent to one of ordinary skill in the art from the following description when taken in conjunction with the accompanying drawings, wherein.

DETAILED DESCRIPTION OF THE PREFERRED EMBODIMENT

Molding strips according to the present invention are used in assembling frame assemblies for the purpose of securing and supporting large sheets of fabric on substrates such as walls. The fabrics form a panel on a wall or the like for purposes not only of decoration, but also for the purpose of absorbing sound in a room, concealment of tackpanel materials, and concealment of other wall features as required. A layer of insulation is placed below the fabrics forming a panel for the purpose of absorbing sound and providing a resilient wall surface.

Figure 7:
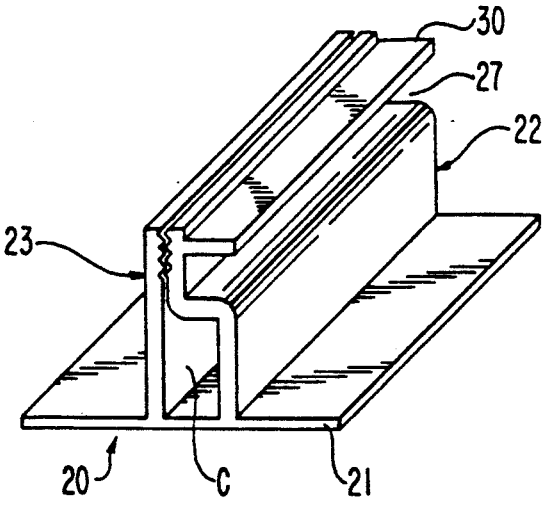
FIG. 7 is a perspective view of a molding strip according to the present invention.
Figure 8:
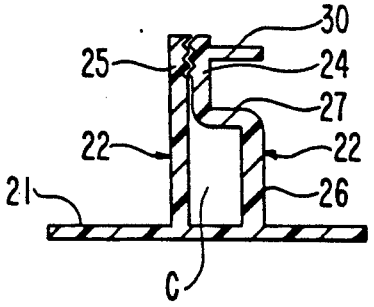
FIG. 8 is an elevational cross-sectional view of the molding strip of FIG. 7.
Figure 9:
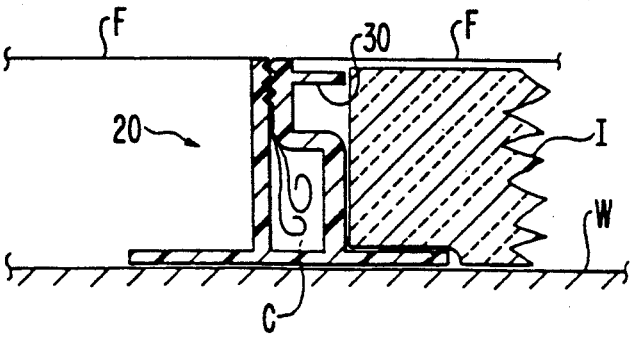
FIG. 9 is a cross-sectional view of the molding strip of FIGS. 7 and 8 shown in use mounted on a wall with a layer of insulation.

The present invention is illustrated in FIGS. 7–9. A molding strip 20 for use in a molding strip assembly as discussed above is provided for supporting flexible materials F. The molding strip 20 is made up of the basic parts of an elongated base 21, a first gripper wall 23, a second gripper wall 22 and a flange 30 extending from the second gripper wall 22.

The base 21 has a backside, a front side and first and second side edges extending in the direction of elongation of the base. As can be seen in the figures, the base portion 21 has front side areas thereof outside of a space C defined between the first and second gripper walls 23 and 22. Either or both of these front side portions outside of the space C can be used for mounting the molding strip 20 on a surface such as a wall. For example, the molding strip 20 can be placed in position and stapled to a wall surface through the front side portions of the base 21. However, it should be recognized that other suitable methods are available for mounting the molding strip 20 onto a support surface.

The first gripper wall 23 extends upwardly from the front side of the base 21. Preferably the first gripper wall is perpendicular or substantially perpendicular to the front side of the base.

The second gripper wall also extends upwardly from the base 21, but from a position on the base which is spaced from the first gripper wall. The separation between the gripper walls allows room for the formation of the space C. The space C accommodates fabric material F therein.

The second gripper wall 22 is made up of a first wall portion 26 which extends from the base at the position spaced from the first gripper wall 23, a second wall portion 27 extending from the first wall portion toward the first gripper wall and a third wall portion 24 extending from the second wall portion parallel to the first gripper wall 23. The second wall portion 27 forms a shoulder as seen in the figures. The first wall portion 26 preferably extends perpendicularly or substantially perpendicularly from the base 21, and is further preferably parallel to the first gripper wall 23. The second wall portion 27 is, further, parallel to the base 21 in the illustrated embodiment. The base 21, the first gripper wall 28, the first wall portion 26 and the second wall portion 27 together define the space C.

The first gripper wall 23 and the third wall portion 24 have mutually confronting portions at the upper end of the molding strip 20. At least one, and preferably both, of the mutually confronting portions have a gripping arrangement thereon. The gripping arrangement is, further, preferably gripper teeth provided on both confronting portions.

A flange 30 extends from the third wall portion 24 of the second gripper wall 22 in a direction away from the first gripper wall 23. The flange 30 extends over and is spaced above the second wall portion 27. The flange 30 thus serves to "fill in" a spaced formed above the second wall portion or shoulder 27 when insulation is placed adjacent the first wall portion 26 below the fabric material.

FIG. 9 illustrates the use of the flange 30. The molding strip 20 is mounted on a wall or other surface W. Fabric materials F are mounted using the molding strip and other molding strip, the material being tucked into the space between the first and second gripper walls 23 and 22, with the remaining portions thereof being contained in the space C. An insulation material I is mounted below the fabric material F, abutting against the first wall portion 26 of the second gripper wall 22. The flange 30 thus fills in the space between the third wall portion 24 and the edge of the insulation I, as seen in the figure.

The flange 30 preferably extends with a flat upper surface that is parallel to the base 21. As can be seen in the figures, the flange 30, further, is preferably located at the upper end of the third wall portion 24 to provide a backing for the fabric material F. However, preferably, while the flange 30 should be placed at the upper end of the third wall portion 24, the flange 30 should also be spaced a small amount from the upper end of the third wall portion such that there is a minimal gap between the upper surface of the flange 30 and the fabric material F. This ensures that the flange 30, while backing the fabric material F, does not positively engage the fabric material F so as to create any creases or lines in the fabric material F which would detract from the appearance of the finished fabric material assembly.

In addition, the flange 30 preferably extends far enough so as to completely or almost completely cover the second wall portion 27. That is, a plane extending perpendicular to the base 21 along the outer surface of the first wall portion 26 is the preferable ending point of the flange 30 as it extends from the third wall portion 24. More generally, the flange 30 can be said to extend to a plane perpendicular to the base and intersecting the position on the base from which the first wall portion 26 extends.

The molding strip 20 which comprises the base 21, the first gripper wall 23, the second gripper wall 22 and the flange 30, is preferably of a unitary, one-piece construction, and is further preferably extruded from a plastic material.

Figure 1:
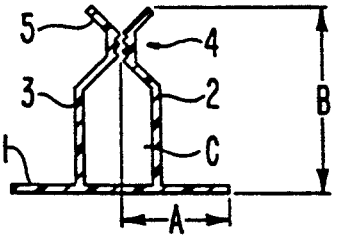
FIG. 1 (PRIOR ART)
FIG. 1 is a cross-section of a prior art molding strip extrusion.
Figure 2:
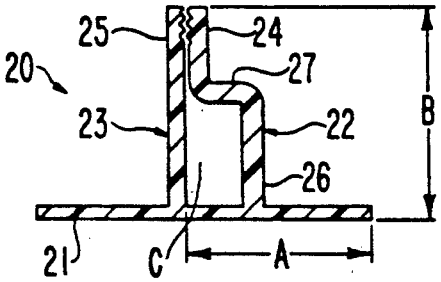
FIG. 2 is an elevational cross-sectional view of a molding strip according to parent U.S. patent application Ser. No. 07/660,232.
Figure 3:
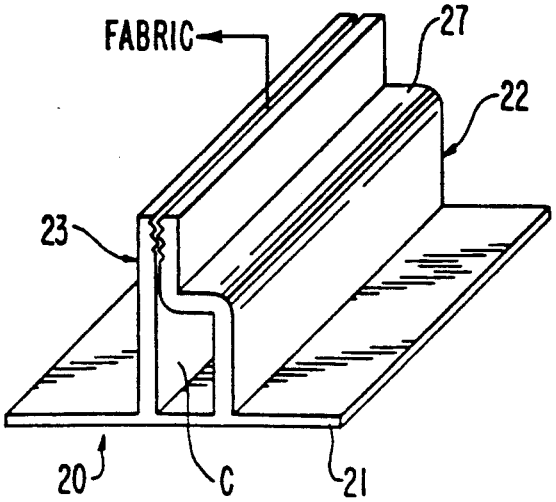
FIG. 3 is a perspective view of the molding strip of FIG. 2.
Figure 4:
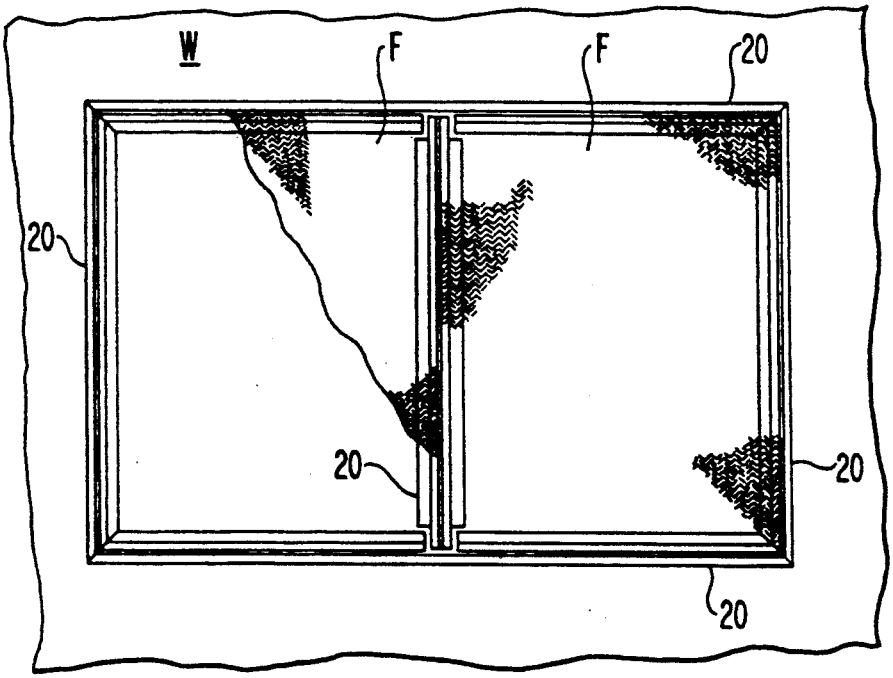
FIG. 4 is a perspective view of a frame assembly using the molding strips of FIGS. 2 and 3.
Figure 5:
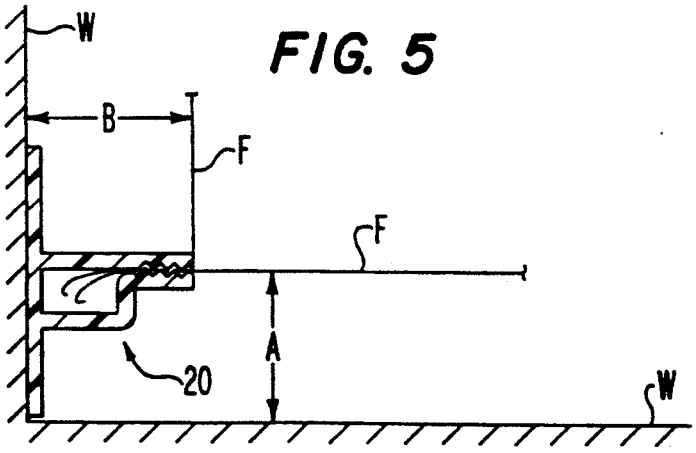
FIG. 5 is a cross-sectional view of a molding strip according to FIG. 2 used as an inside corner junction for a fabric wall covering.
Figure 6:
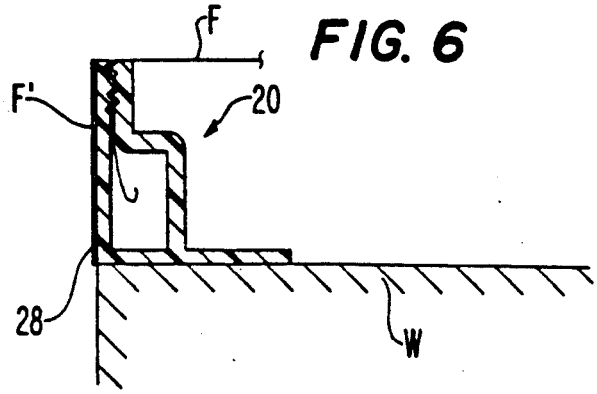
FIG. 6 is a cross-sectional view of a molding strip according to FIG. 2 that has been modified for special use.

In addition, the relationship between dimensions A and B illustrated in FIG. 2 with regard to the molding strip 20 as disclosed in U.S. patent application Ser. No. 07/660,232 is also preferably applied to the molding strip 20 according to the present invention.

Generally, a nominal one inch height of the molding strips 20 is desirable. This size of the molding strip, when used in forming frame assemblies for fabric panels, is particularly suitable for purposes of making panel assemblies that absorb sound frequencies in certain key frequencies in human hearing. That is, an absorbing material of one inch thickness has a substantial effect in absorbing speech and mechanical noise at frequencies of 1,000 Hz and higher. 1,000 Hz roughly corresponds to the center frequency of human speech and hearing.

However, a standard half inch height of the molding strips 20 may also be used, where sound absorption is less important. A half inch height of the molding strip 20 still allows for a sufficiently size spaced C to allow easy alignment of the horizontally repeating fabric patterns, i.e. a half inch sized molding strip in accordance with the present invention still provides a substantially large space C.

Although the present invention has been described and illustrated with respect to specific features thereof, it is to be understood that various modifications and changes may be made to the specifically described and illustrated features without departing from the scope of the present invention.

We claim:

1. A molding strip for use in a molding strip assembly for supporting flexible materials, said molding strip comprising:

an elongated base having a back side, a front side and first and second side edges extending in the direction of elongation of said base;

a first gripper wall extending substantially perpendicularly from said front side of said base;

a second gripper wall comprising a first wall portion extending from said base at a position on said base spaced form said first gripper wall, a second wall portion extending from said first wall portion toward said first gripper wall so that a space is defined by said base, said first gripper wall, said first wall portion of said second gripper wall and said second wall portion of said second gripper wall, and a third wall portion extending from said second wall portion parallel to said first gripper wall, said first gripper wall and said third wall portion having mutually confronting portions with at least one of said mutually confronting portions having a gripping arrangement thereon; and a flange extending from said third wall portion of said second gripper wall in a direction away from said first gripper wall, over said second wall portion and spaced form said second wall portion;

wherein said flange extends parallel to said base;

wherein said flange has a flat surface; and wherein said flange extends from a point on said third wall portion substantially above said second wall portion and substantially at, but spaced from, the upper end of said third wall portion.

2. The molding strip of claim 1, wherein said flange extends to a plane perpendicular to said base and intersecting said position on said base from which said first wall portion extends.

3. The molding strip of claim 1, wherein gripping arrangements are on both said mutually confronting portions.

4. The molding strip of claim 3, wherein said gripping arrangements comprise gripper teeth.

5. The molding strip of claim 1, wherein said front side of said base has at least one portion outside of said space.

6. The molding strip of claim 1, wherein the distance in a direction perpendicular to said base from said back side of said base to the upper end of said first gripper wall is equal to the distance in a direction substantially parallel to said base from said first side edge to a line extending substantially centrally between said mutually confronting portions of said first and second gripper walls and perpendicular to said base.

7. The molding strip of claim 1, wherein the distance in a direction perpendicular to said base from said back side of said base to the upper end of said first gripper wall is one inch.

8. The molding strip of claim 1, wherein the distance in a direction perpendicular to said base from said back side of said base to the upper end of said first gripper wall is one-half inch.

9. The molding strip of claim 1, wherein said base, said first and second gripper walls and said flange are unitary in a one-piece arrangement.

10. The molding strip of claim 1, wherein said one-piece arrangement is an extrusion of a plastic material.

11. A molding strip for use in a molding strip assembly for supporting flexible materials, said molding strip comprising:

an elongated base having a back side, a front side and first and second side edges extending in the direction of elongation of said base;

a first gripper wall extending substantially perpendicularly form said front side of said base;

a second gripper wall comprising a first wall portion extending from said base at a position on said base spaced from said first gripper wall, a second wall portion extending from said first wall portion toward said first gripper wall so that a space is defined by said base, said first gripper wall, said first wall portion of said second gripper wall and said second wall portion of said second gripper wall, and a third wall portion extending from said second wall portion parallel to said first gripper wall, said first gripper wall and said third wall portion having mutually confronting portions with at least one of said mutually confronting portions having a gripping arrangement thereon; and a flange extending from said third wall portion of said second gripper wall in a direction away from said first gripper wall, over said second wall portion and spaced from said second wall;

wherein said flange extends parallel to said base;

wherein said flange has a flat surface; and wherein said flat upper surface of said flange extends at a location below the upper ends of said first and second grippe walls.

12. A molding strip for use in a molding strip assembly for supporting flexible materials, said molding strip comprising:

an elongated base having a back side, a front side and first and second side edges extending in the direction of elongation of said base;

a first gripper wall extending substantially perpendicularly from said front side of said base;

a second gripper all comprising a first wall portion extending from said base at a position on said base spaced from said first gripper wall, a second wall portion extending from said first wall portion toward said first gripper wall so that a space is defined by said base, said first gripper wall, said first wall portion of said second gripper wall and said second wall portion of said second gripper wall, and a third wall portion extending from said second wall portion parallel to said first gripper wall, said first gripper wall and said third wall portion having mutually confronting portions with at least one of said mutually confronting portion shaving a gripping arrangement thereon; and a flange extending from said third wall portion of said second gripper wall in a direction away form said first gripper wall, over said second wall portion and spaced form said second wall portion;

wherein said second wall portion is parallel to said base; and wherein said flange has a flat upper surface parallel to said second wall portion.

13. The molding strip of claim 12, wherein said first and third wall portions are parallel to said first gripper wall.

14. A molding strip for use in a molding strip assembly for supporting flexible materials on a surface with insulation provided between the flexible materials and the surface, said molding strip comprising:

an elongated base having a back side, a front side and first and second side edges extending in the direction of elongation of said base;

a first gripper wall extending substantially perpendicularly from said front side of said base;

a second gripper wall comprising a first wall portion extending from said base at a position on said base spaced from said first gripper wall, a second wall portion extending from said first wall portion toward said first gripper wall so that a space is defined by said base, said first gripper wall, said first wall portion of said second gripper wall and said second wall portion of said second gripper wall, and a third wall portion extending from said second wall portion parallel to said first gripper wall, said first gripper wall and said third wall portion having mutually confronting portions with at least one of said mutually confronting portions having a gripping arrangement thereon, and said first and second wall portions defining a shoulder on said second gripper wall; and means extending from said third wall portion for covering a space formed above said shoulder between said third wall portion and insulation placed adjacent said shoulder when said molding strip is used together with insulation, said means comprising a flange having a flat upper surface extending parallel to said elongated base at a location below the upper ends of said first and second gripper walls such that, when a flexible material is supported by said molding strip, said means has no effect on the surface appearance of the flexible material.

* * * * *